US008206002B1

(12) United States Patent
Olson

(10) Patent No.: US 8,206,002 B1
(45) Date of Patent: Jun. 26, 2012

(54) MODULAR LIGHTED FLOOR MAT FOR USE BENEATH EQUIPMENT

(76) Inventor: Timothy Andrew Olson, Rice, MN (US)

( * ) Notice: Subject to any disclaimer, the term of this patent is extended or adjusted under 35 U.S.C. 154(b) by 171 days.

(21) Appl. No.: 12/647,607

(22) Filed: Dec. 28, 2009

(51) Int. Cl.
*F21V 33/00* (2006.01)
*B25H 5/00* (2006.01)

(52) U.S. Cl. ..... 362/153.1; 362/153; 362/253; 280/32.6

(58) Field of Classification Search ..... 362/145, 362/153, 488, 253, 153.1; 280/32.6
See application file for complete search history.

(56) References Cited

U.S. PATENT DOCUMENTS 5,848,830 A * 12/1998 Castle et al. ..... 362/84
6,481,877 B1 * 11/2002 Bello, Jr. ..... 362/488
6,540,378 B2 * 4/2003 Alsup ..... 362/253
6,773,129 B2 * 8/2004 Anderson et al. ..... 362/84
7,305,728 B2 * 12/2007 Schlieps ..... 5/657
7,597,949 B2 * 10/2009 Wright ..... 428/116
7,670,026 B1 * 3/2010 Hawkins ..... 362/249.05
8,025,299 B2 * 9/2011 Hiltz ..... 280/32.6
8,128,253 B2 * 3/2012 Opitz et al. ..... 362/153
2006/0028819 A1 * 2/2006 Shankland et al. ..... 362/253
2010/0079985 A1 * 4/2010 Prosey ..... 362/183
2010/0123293 A1 * 5/2010 Benjamin ..... 280/32.6

* cited by examiner

*Primary Examiner* — Peggy A. Neils
(74) *Attorney, Agent, or Firm* — David Alan Lingbeck

(57) ABSTRACT

A modular lighted floor mat for use beneath equipment for providing hands-free light necessary to work on the equipment. The modular lighted floor mat for use beneath equipment includes a lighted floor mat assembly including a base member, light-emitting members, and a transparent load-bearing cover being disposed over the light-emitting members and the base member and being capable of withstanding substantial weights and also being impervious to chemicals.

10 Claims, 3 Drawing Sheets

MODULAR LIGHTED FLOOR MAT FOR USE BENEATH EQUIPMENT

BACKGROUND OF THE INVENTION

1. Field of the Invention

The present invention relates to floor mats and more particularly pertains to a new modular lighted floor mat for use beneath equipment for providing hands-free light necessary to work on the equipment.

2. Description of the Prior Art

The use of floor mats is known in the prior art. More specifically, floor mats heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a lighted floor mat system which has a mat with first and second portions and also including a light source being protectively disposed under the first portion with the first portion being designed to represent a logo with the light source shining through the logo and with the light source being coated in polycarbonate resin for protection. Another prior art includes a lighted automotive floor mat including a flexible and durable material for covering the floor of a vehicle and including a plurality of lamps in the fabric of the mat. Also another prior art includes a floor mat having a transparent first sheet overlaid upon a second sheet and sealed about a perimeter edge to define a pocket for receiving advertisements. Yet, another prior art includes modular floor covering units with built-in lighting.

While these devices fulfill their respective, particular objectives and requirements, the aforementioned patents do not disclose a new modular lighted floor mat for use beneath equipment.

SUMMARY OF THE INVENTION

The general purpose of the present invention, which will be described subsequently in greater detail, is to provide a new modular lighted floor mat for use beneath equipment which has many of the advantages of the floor mats mentioned heretofore and many novel features that result in a new modular lighted floor mat for use beneath equipment which is not anticipated, rendered obvious, suggested, or even implied by any of the prior art floor mats, either alone or in any combination thereof. The present invention includes a lighted floor mat assembly including a base member, light-emitting members, and a transparent load-bearing cover being disposed over the light-emitting members and the base member and being capable of withstanding substantial weights and also being impervious to chemicals. None of the prior art includes the combination of the elements of the present invention.

There has thus been outlined, rather broadly, the more important features of the modular lighted floor mat for use beneath equipment in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new modular lighted floor mat for use beneath equipment which has many of the advantages of the floor mats mentioned heretofore and many novel features that result in a new modular lighted floor mat for use beneath equipment which is not anticipated, rendered obvious, suggested, or even implied by any of the prior art floor mats, either alone or in any combination thereof.

Still another object of the present invention is to provide a new modular lighted floor mat for use beneath equipment for providing hands-free light necessary to work on the equipment.

Still yet another object of the present invention is to provide a new modular lighted floor mat for use beneath equipment that is strong enough to withstand either equipment or the user resting on top thereof.

Even still another object of the present invention is to provide a new modular lighted floor mat for use beneath equipment that eliminates the user having to fumble around using lamps or flashlights to light up the area beneath the equipment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
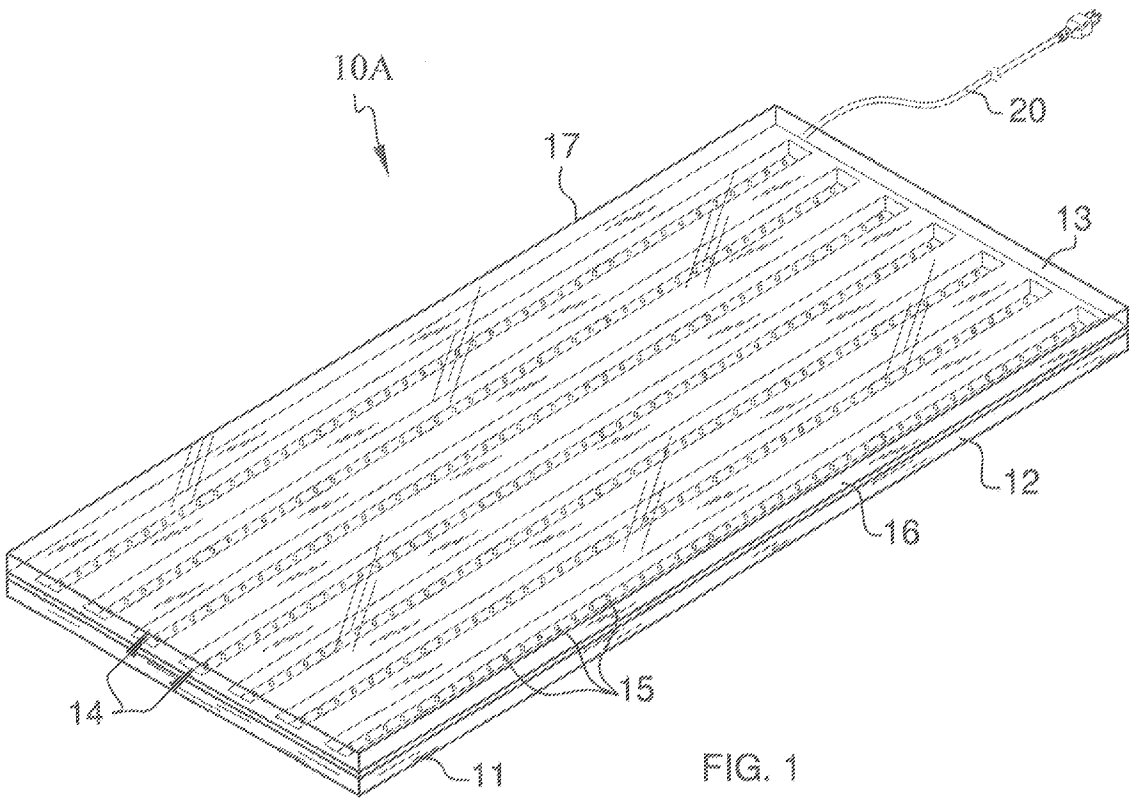
FIG. 1 is a perspective view of a new modular lighted floor mat for use beneath equipment according to the present invention.
Figure 2:
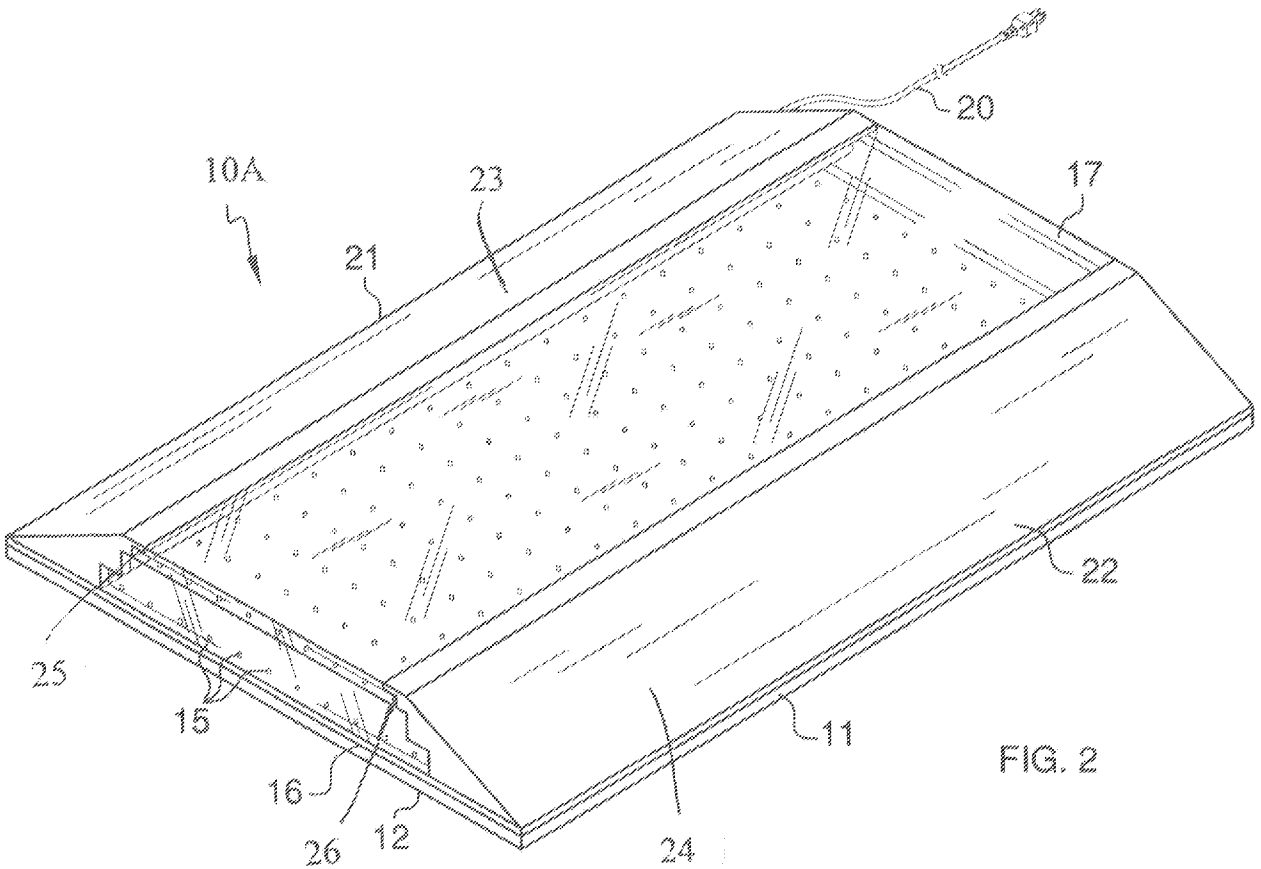
FIG. 2 is a perspective view of a second embodiment of the present invention.
Figure 3:
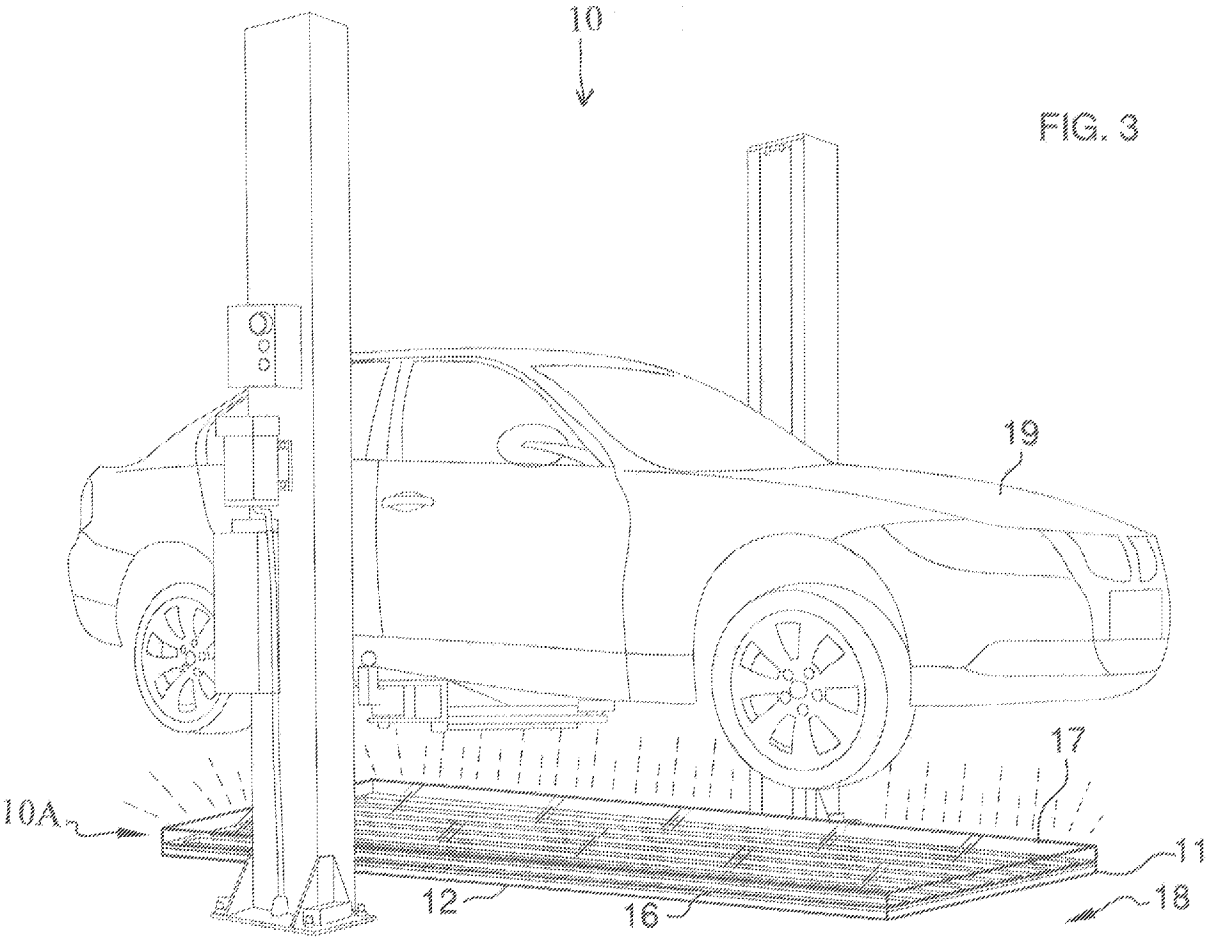
FIG. 3 is a perspective view of the present invention being used beneath a vehicle in particular.

With reference now to the drawings, and in particular to FIGS. 1 through 3 thereof, a new modular lighted floor mat for use beneath equipment embodying the principles and concepts of the present invention and generally designated by the reference numeral 10 will be described.

As best illustrated in FIGS. 1 through 3, the modular lighted floor mat for use beneath equipment 10 generally comprises a lighted floor mat assembly 10A including a base member 11, light-emitting members 15, and a transparent load-bearing cover 17 being disposed over the light-emitting members 15 and the base member 11 and being capable of withstanding substantial weights and also being impervious to chemicals. The base member 11 is a planar material 12 having a thickness and a topside 13. One embodiment includes the light-emitting members 15 being spaced about and embedded in the topside 13 of the base member 11. Another embodiment includes the lighted floor mat assembly 10A having light reflective material 16 being securely and conventionally disposed upon the base member 11 to reflect and enhance light from the light-emitting members 15 through the transparent load-bearing cover 17. The light reflective material 16 is a sheet of light reflective material 16 being securely and conventionally disposed upon and substantially covering the topside 13 of the planar material 12 with the sheet of light reflective material 16 having a light reflective topside. The light-emitting members 15 are spacedly and securely disposed upon the sheet of light reflective material 16 and are connectable to a power source with a power cord 20 which is conventionally connected to the light-emitting members 15 such that light from the light-emitting members 15 is reflected and enhanced by the sheet of light reflective material 16 through the transparent load-bearing cover 17.

The modular lighted floor mat 10 further includes a machine 19 being disposed upon a ground 18 with the lighted floor mat assembly 10A being disposed beneath the machine 19 upon the ground 18 to provide sufficient light under the machine 19 upon the light-emitting members 15 being energized to facilitate a user working on the machine 19. The lighted floor mat assembly 10A is positioned beneath the machine 19 to not only provide light thereunder but to also support the user positioning oneself upon the transparent load-bearing cover 17 while working beneath the machine 19.

As another embodiment, the planar material 12 has elongate grooves 14 being disposed in the topside 13 thereof with the elongate grooves 14 being spaced apart and extending end to end of the planar material 12. The sheet of light reflective material 16 is securely and conventionally disposed upon the topside 13 and in the elongate grooves 14 of the planar material 12. The light-emitting members 15 are conventionally disposed in the elongate grooves 14 of the planar material 13 upon the sheet of light reflective material 16 to provide sufficient light beneath the machine 19 to facilitate the user working on the machine 19.

In another embodiment, the modular lighted floor mat 10 includes cover support members 21,22 being conventionally attached to and disposed upon the base member 11. The cover support members 21,22 are spaced apart and extend along respective side edges of the base member 11. The cover support members 21,22 are tapered toward the side edges of the base member 11 and has a top 23,24 which is slanted downwardly toward the side edges of the base member 11 to facilitate a user getting on and off the lighted floor mat assembly 10A. Each of the cover support members 21,22 has a ledge 25,26 being conventionally disposed on a side thereof below the top 23,24 and extending along a length of a respective cover support member 21,22. The transparent load-bearing cover 17 has edges which are securely and conventionally supported upon the ledges 25,26 between the cover support members 21,22.

In use, the user positions the lighted floor mat assembly 10A upon a ground 18 where the user needs the light, and then positions a machine 19 to be worked upon over the lighted floor mat assembly 10A by elevating the machine 19 using appropriate lifting devices if the clearance between the lighted floor mat assembly 10A and the machine 19 is not high enough to allow the user under the machine 19, or the user first positions the machine 19 over the floor 18 and then positions the lighted floor mat assembly 10A on the ground 18 under the machine 19. The user energizes the light-emitting members 15 by plugging in the power cord 20 in an appropriate power source to provide light beneath the machine 19. The user can use low wattage light-emitting members 15 to guard against the light-emitting members 15 becoming too hot but yet still provide the light necessary to light up the underside of the machine 19 because the sheet of light reflective material 16 will reflect and brighten the light through the transparent load-bearing cover 17. The user can position the lighted floor mat 10 in alignment under the machine 19 to provide light to the portion of the machine 19 the user needs to work on, and the user can position oneself upon the lighted floor mat 10 and upon the transparent load-bearing cover 17 to work on the machine 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the modular lighted floor mat for use beneath equipment. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modular lighted floor mat for use beneath equipment comprising:

a lighted floor mat assembly including a base member being that of a planar material and having a thickness and a topside and also including light-emitting members being supported by said base member and being energizable by a power source, and further including a transparent load-bearing cover being disposed over said light-emitting members and said base member and being capable of withstanding substantial weights and also being impervious to chemicals, and also including a sheet of light reflective material being securely supported by said base member to reflect and enhance light from said light-emitting members through said transparent load-bearing cover, said sheet of light reflective material having a light reflective topside, said light-emitting members being spacedly and disposed over said sheet of light reflective material and being energizable by a power source such that light from said light-emitting members is reflected and enhanced through said transparent load-bearing cover, said lighted floor mat assembly capable of being disposed beneath a machine upon a ground to provide sufficient light under the machine upon said light-emitting members being energized to facilitate a user working on the machine and to support the user positioning oneself upon the transparent load-bearing cover.

2. A modular lighted floor mat for use beneath equipment comprising a lighted floor mat assembly including a base member being that of a planar material and having a thickness and a topside and also including light-emitting members being supported by said base member and being energizable by a power source, said lighted floor mat assembly capable of being disposed beneath a machine upon a ground to provide sufficient light under the machine upon said light-emitting members being energized to facilitate a user working on the machine, and further including a transparent load-bearing cover being disposed over said light-emitting members and said base member and being capable of withstanding substantial weights and also being impervious to chemicals and to also support the user positioning oneself upon the transparent load-bearing cover.

3. The modular lighted floor mat for use beneath equipment as described in claim 2, wherein said planar material has elongate grooves being disposed in said topside thereof, said elongate grooves being spaced apart and extending end to end of said planar material, said light-emitting members being disposed in said elongate grooves.

4. The modular lighted floor mat for use beneath equipment as described in claim 3, wherein said lighted floor mat assembly also includes a sheet of light reflective material being securely disposed upon said topside and in said grooves of said planar material, said sheet of light reflective material having a light reflective topside.

5. The modular lighted floor mat for use beneath equipment as described in claim 4, wherein said light-emitting members are disposed in said grooves of said planar material and upon said sheet of light reflective material to provide sufficient light beneath said machine to facilitate the user working on the machine.

6. The modular lighted floor mat for use beneath equipment as described in claim 2 further includes cover support members being attached to and disposed upon said base member, said cover support members being spaced apart and extending along respective side edges of said base member.

7. The modular lighted floor mat for use beneath equipment as described in claim 6, wherein each said cover support members is tapered toward the side edges of said base member and has a top which is slanted downwardly toward the side edges of said base member to facilitate the use thereof.

8. The modular lighted floor mat for use beneath equipment as described in claim 7, wherein each of said cover support members has a ledge being disposed on a side thereof below said top and extending along a length of a respective said cover support member.

9. The modular lighted floor mat for use beneath equipment as described in claim 8, wherein said transparent load-bearing cover is securely supported upon said ledges between said cover support members.

10. The modular lighted floor mat for use beneath equipment as described in claim 9, wherein said lighted floor mat assembly also includes a sheet of light reflective material being supported by said base member between said cover support members to reflect and enhance light from said light-emitting members through said transparent load-bearing cover, said sheet of light reflective material having a light reflective topside.

* * * * *